United States Patent [19]

Nordmeyer et al.

[11] Patent Number: 4,991,632

[45] Date of Patent: Feb. 12, 1991

[54] METHOD OF GENTLY PACKING A PRODUCT

[75] Inventors: Manfred Nordmeyer; Wolfgang Nienstedt; Helmut Gruene, all of Schwarmstedt, Fed. Rep. of Germany

[73] Assignee: Lieder Maschinenbau GmbH & Co. KG, Schawarmstedt, Fed. Rep. of Germany

[21] Appl. No.: 258,144

[22] Filed: Oct. 7, 1988

[30] Foreign Application Priority Data

Oct. 10, 1987 [DE] Fed. Rep. of Germany ..... 3734361

[51] Int. Cl.[5] ..... B65B 1/04

[52] U.S. Cl. ..... 141/1; 141/95; 141/177; 141/256; 222/227; 222/236

[58] Field of Search ..... 141/1, 135, 138, 139, 141/177, 94, 95, 227–229, 256, 266, 258–260; 222/227, 236, 238, 363, 368

[56] References Cited

U.S. PATENT DOCUMENTS

| | | | |
|---|---|---|---|
| 1,013,674 | 1/1912 | Millard | 222/227 |
| 2,674,396 | 4/1954 | Peterson | 222/227 |
| 2,716,510 | 8/1955 | Massmann | 222/363 |
| 2,935,233 | 5/1960 | Vogt | 141/1 X |
| 4,083,475 | 4/1978 | Venner et al. | 222/238 |
| 4,129,159 | 12/1978 | Whetstone | 141/1 |
| 4,158,374 | 6/1979 | Ciuffetti | 222/363 |
| 4,347,876 | 9/1982 | Morgan | 141/94 |
| 4,448,331 | 5/1984 | Millette et al. | 222/363 |
| 4,513,671 | 4/1985 | Eshleman | 141/94 |
| 4,662,409 | 5/1987 | Egli | 141/1 |
| 4,763,702 | 8/1988 | High, Jr. et al. | 141/256 X |
| 4,860,926 | 8/1989 | Juenkersfeld et al. | 141/258 X |

FOREIGN PATENT DOCUMENTS

| | | | |
|---|---|---|---|
| 1963382 | 6/1971 | Fed. Rep. of Germany | 222/227 |
| 1242420 | 7/1986 | U.S.S.R. | 141/256 |

*Primary Examiner*—Henry J. Recla
*Assistant Examiner*—Casey Jacyna
*Attorney, Agent, or Firm*—Peter K. Kontler

[57] ABSTRACT

The method serves to gently pack a product the consistency of which can be affected by external influences. The product consists of a number of separable components which adhere to one another to at least some extent and are readily deformed under the influence of mechanical forces. The product is piled in a position of potential energy from which it is directed into a measuring vessel by gravity. After it is filled, the measuring vessel is tilted and, in its tilted position, is emptied by gravity into a waiting packing unit below it.

20 Claims, 11 Drawing Sheets

79
3
77
91
92
93
MAX
82
81
83
88
84
85
87
MIN
80
86
77
SHUT
OPEN
94
95
α
99
4
90
SHUT
OPEN
97
102
98
96
100
101

METHOD OF GENTLY PACKING A PRODUCT

BACKGROUND OF THE INVENTION

The invention relates to a method for gently packing a product the consistency of which can be affected by external influences and composed of a number of separable components which adhere to one another to at least some extent and are readily deformed by mechanical forces. The invention also relates to an apparatus for gently packing a product the consistency of which can be readily affected by external influences, the apparatus including a measuring vessel movably mounted in a housing and having an inlet opening which, after a displacement of the measuring vessel, constitutes an outlet opening facing a packing unit to be filled.

There is a significant need for such methods and apparatus which greatly increases with increasing use of prepared foods. As long as relative movement of the components of these products is enhanced by a lubricant between the same, it is possible to use recently developed apparatus which have had the opportunity to demonstrate positive results. However, when such a lubricant, for example, sauces or liquids, is not present between the individual components, there is the great danger that the sliding characteristics of the individual components relative to one another are so bad that an obstruction, below which a cavity is formed as considered in the flow direction of the product, develops at some location of a packing apparatus. Very frequently, this cavity can only be eliminated by manual intervention so that such packing methods and apparatus are time-consuming and expensive.

It has further been attempted to mechanically exert forces on the individual components. Here, there is the danger that the consistency of the individual components will be greatly altered so that they lose their natural appearance. For example, such problems arise during the packing of dried peas which are very frequently completely deformed when subjected to mechanical forces in order to keep them flowing in a stream during the packing process.

OBJECT OF THE INVENTION

It is accordingly an object of the present invention to improve a method of the above type such that fully automatic packing of the product becomes possible.

SUMMARY OF THE INVENTION

In accordance with the invention, this object is achieved by heaping the product in a position of potential energy from where it is guided, by gravity, into a measuring vessel which is tilted after filling and, in its tilted position, is emptied into a waiting packing unit below it due to gravity.

This method has the great advantage that it does not require the exertion of force on the product to be packed. Once the product has been set in motion, it is kept in motion by carefully controlled means until it has been filled into the packing unit. The creation of obstructions, from which the product can again be converted into a product stream only with difficulty, is prevented during the packing process. The product which has been carefully converted into the product stream does not undergo any damage in its consistency and can, therefore, be very precisely measured and packed in predetermined discrete quantities.

According to a preferred embodiment of the invention, the size of the measuring vessel is matched to that of the packing unit. In this manner, it is possible to fill different packing units with the intended quantity of the product; the product moving in a direction towards the measuring vessel need not be subjected to any influence other than that of the tiltable measuring vessel which most carefully and gently measures out from the product conveyed thereto that quantity capable of being packed in a packing unit. The product can be accelerated, if necessary, by a low gas pressure.

There have been no apparatus until now for such a gentle handling of the product. The existing apparatus frequently led to operational malfunctions which, as a rule, could only be eliminated by manual intervention in the product stream. This created various drawbacks which, in particular, caused the filling times to be substantially increased and made it possible to pack the product only after manual contact. It is desired, however, for packing to be independent of manual intervention.

Therefore, it is another object of the present invention to improve an apparatus of the above type such that the product to be packed can be packed without the need to manually intervene in the product stream.

In accordance with the invention, this object is achieved in that the inlet opening is disposed immediately below a conveying shaft in which the product is heaped with a potential energy sufficient to fill the measuring vessel.

Such an apparatus is capable of converting the product, without pressure, into a product stream which allows the product to be advanced to the packing units in the absence of forces which damage its components. Moreover, this apparatus is relatively inexpensive. Measurement of the respective discrete product quantities to be packed can be accomplished without providing the individual components of the product with a lubricating layer which enhances frictional characteristics. The product enters the measuring device solely by gravity without the need to subject the product to additional forces. The product is again emptied from the measuring vessel in a direction towards the packing units in the same manner. Here, also, no forces which could result in deformation of the individual components are employed. Even the gas which is introduced for acceleration if necessary is not capable of deforming the product.

According to a preferred embodiment of the invention, the measuring vessel is pivotally mounted in the housing. Due to the pivotal mounting of the measuring vessel, the individual movements can be well regulated and performed rapidly. Furthermore, during pivoting of the measuring vessel, there is also no danger that individual components of the product will become clamped in a gap between the housing and the pivotable measuring vessel.

In accordance with another preferred embodiment of the invention, the product is removed from a supply by a grab and converted into a flowing product stream which is supplied to an equalizing conveying device from where it is guided through a conveying shaft without pressure and into a distributing device and then advanced into a packing unit.

By means of this procedure, the product is loosened in the region of the supply to be packed and converted into a flowing product stream without having to subject the product to forces which change the consistency of the individual components. The product is kept in motion until it has been filled into the packing unit. Short intermediate storage periods are selected such that the product cannot set until it has been finally filled into the packing unit. In this manner, the individual components are prevented from adhering to one another so that they can again be made to flow only by the use of substantial accelerating forces.

According to an additional preferred embodiment of the invention, the grab is moved continuously in a direction towards the supply. The continuity of movement of the grab causes the individual components to always remain in motion during movement of the grab so that large accelerations and, hence, large deforming forces are not required. The individual components are in a constant state of flux while the grab moves.

In accordance with a further preferred embodiment of the invention, a grab which engages the product is arranged in a supply of the product. A conveying device is disposed in the operative region of the grab and has a conveying end connected to a conveying shaft which accepts and advances the product without pressure. At the end thereof facing away from the conveying device, the conveying shaft opens into the inlet side of a distributing device. A packing unit to be filled with the product is provided at the outlet side of the distributing device.

Such an apparatus is capable of converting the product, largely without pressure, into a product stream which allows the product to be advanced to the packing units without forces damaging to its components. In addition, this apparatus is relatively inexpensive. The individual components of the apparatus are matched to one another in such a way that the conveyed product is constantly in motion.

According to another preferred embodiment of the invention, the grab is provided with rotatable grabbing arms whose region of rotation is at least partially within the supply. These rotatable grabbing arms engage the supply of the product particularly gently. They can be precisely positioned so that they operate exactly at those locations of the product where obstructions in the product stream occur most frequently and are most difficult to eliminate. Moreover, the grabs can be driven by structurally very simple means. The grabbing arms maintain the individual components in motion until they are engaged by the conveying device and further advanced by the same.

Additional details of the invention are forthcoming from the following detailed description, as well as the accompanying drawings which, by way of example, illustrate preferred embodiments of the invention.

DESCRIPTION OF PREFERRED EMBODIMENTS

Figure 1:
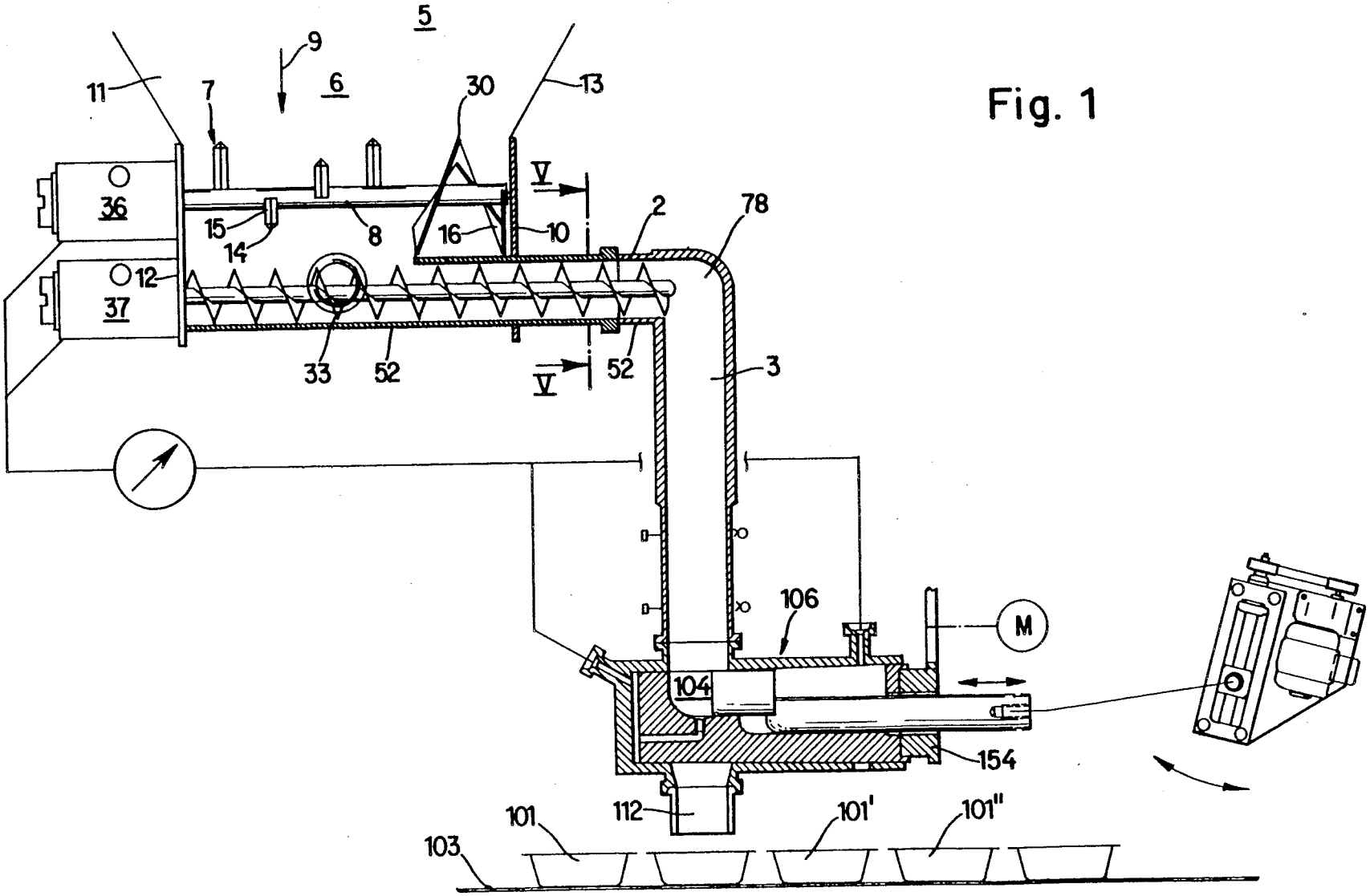
FIG. 1 is a schematic of an apparatus.
Figure 2:
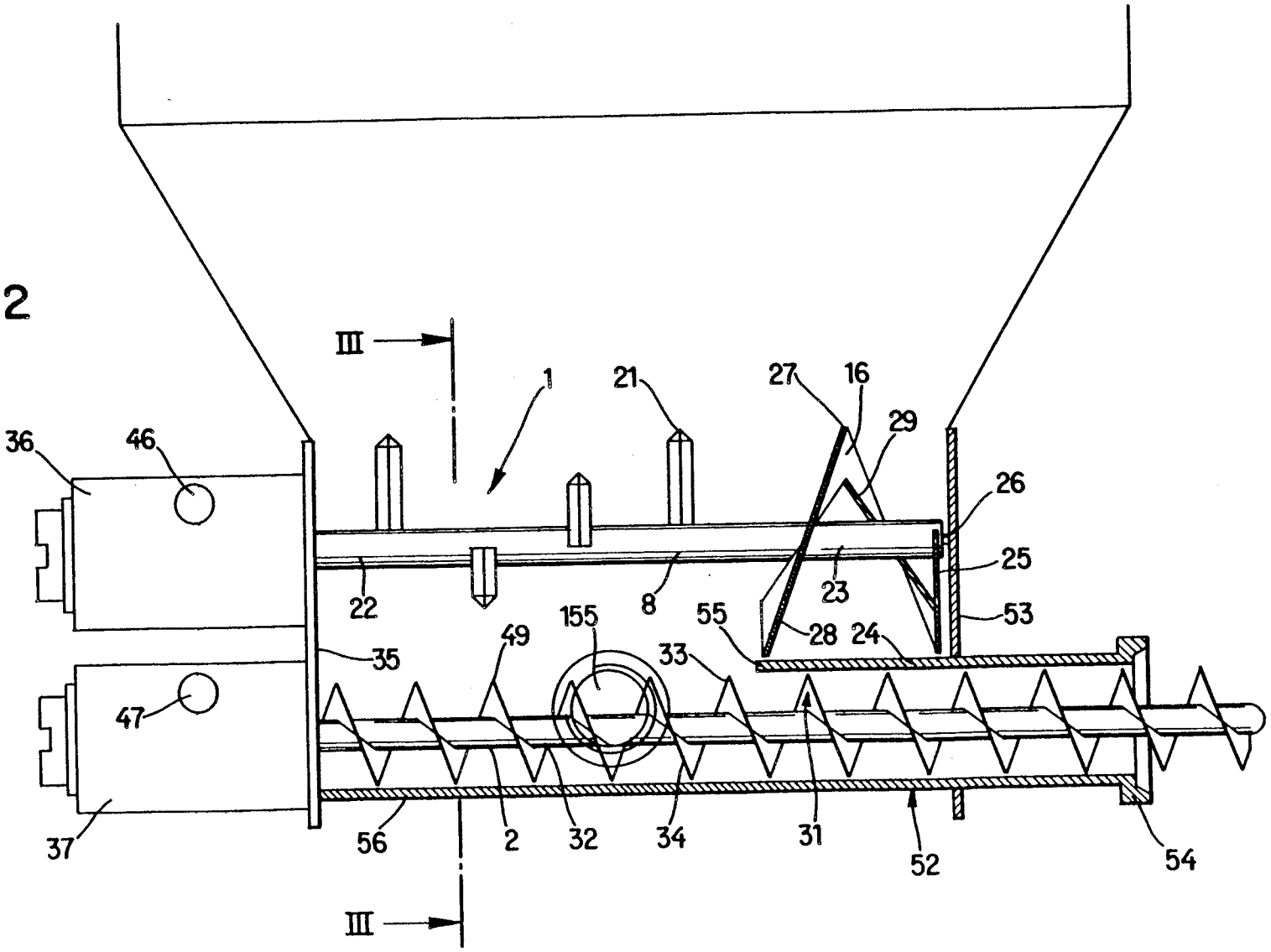
FIG. 2 is a side view of a housing with a grabbing tool and a conveying device mounted therein.
Figure 3:
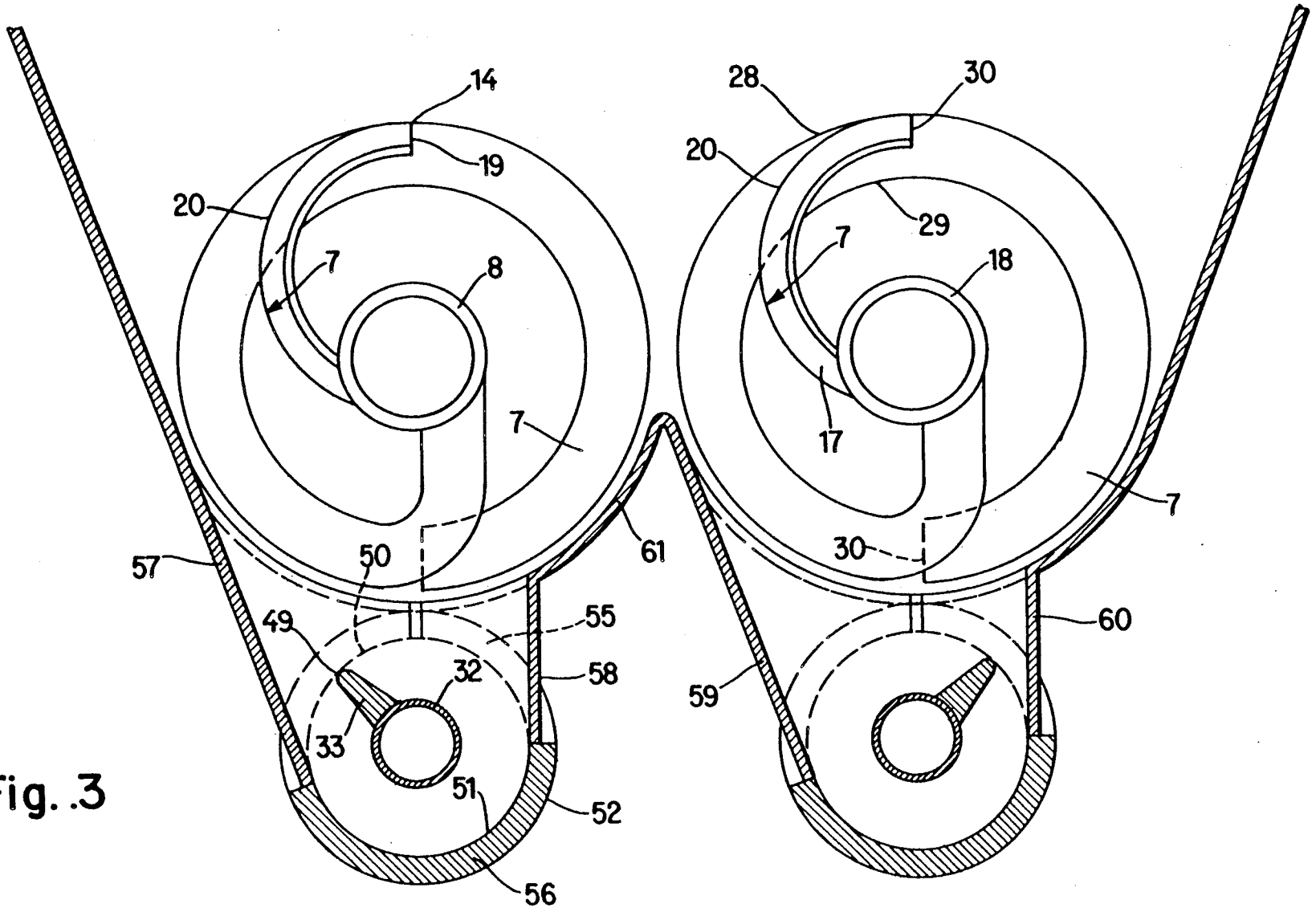
FIG. 3 is a cross section of a housing, along the section line III—III of FIG. 2, having grabbing tools and conveying devices mounted therein.
Figure 4:
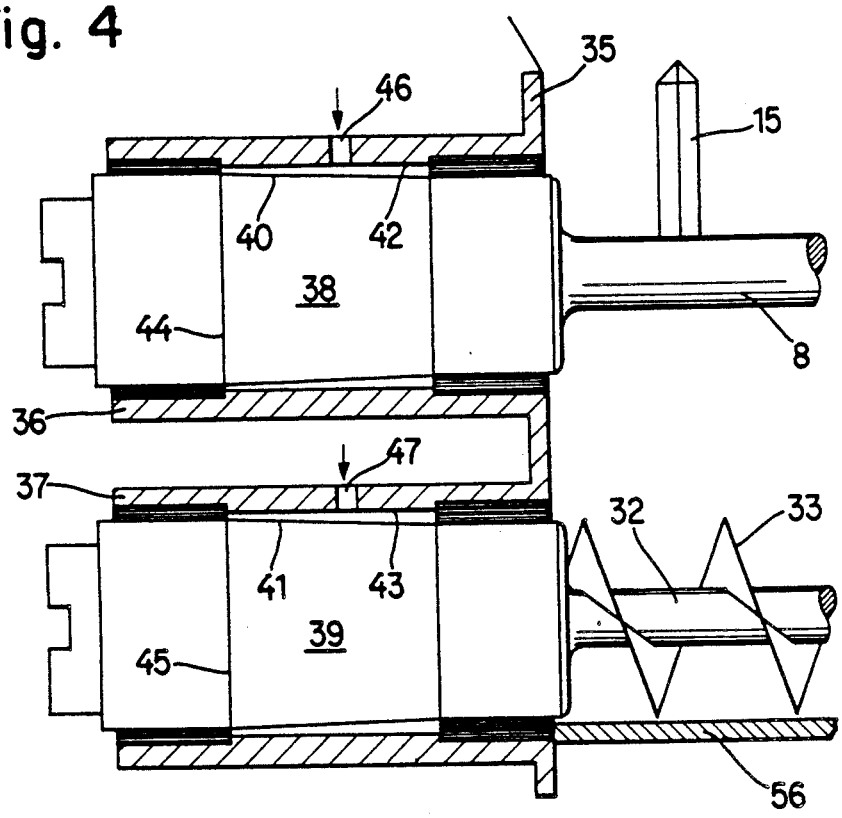
FIG. 4 is a longitudinal section of a bearing for the shafts of a grabbing tool, on the one hand, and a conveying device, on the other hand.
Figure 5:
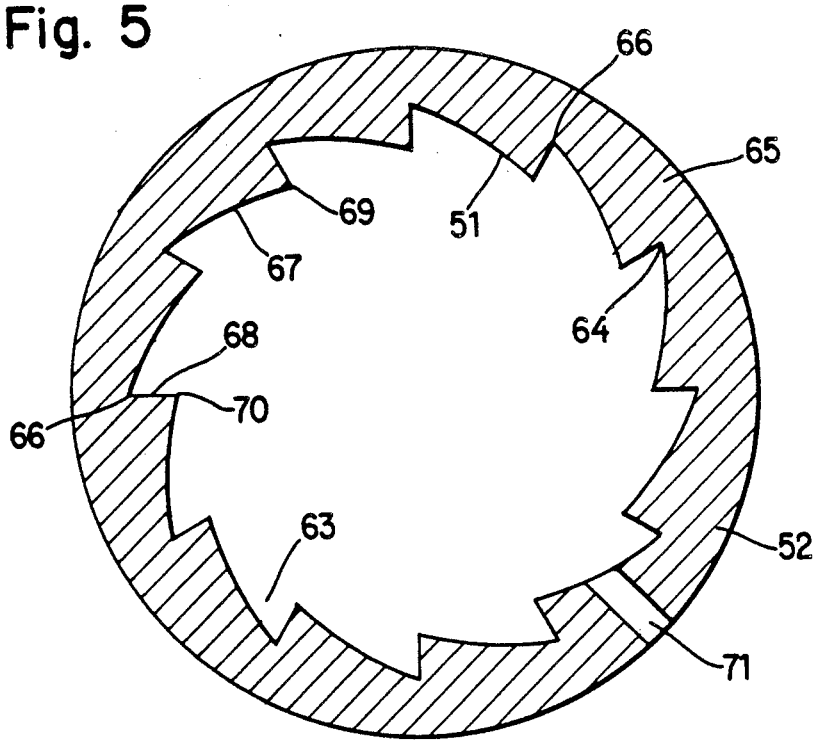
FIG. 5 is a cross section of a tube along the section line V—V of FIG. 1.
Figure 6:
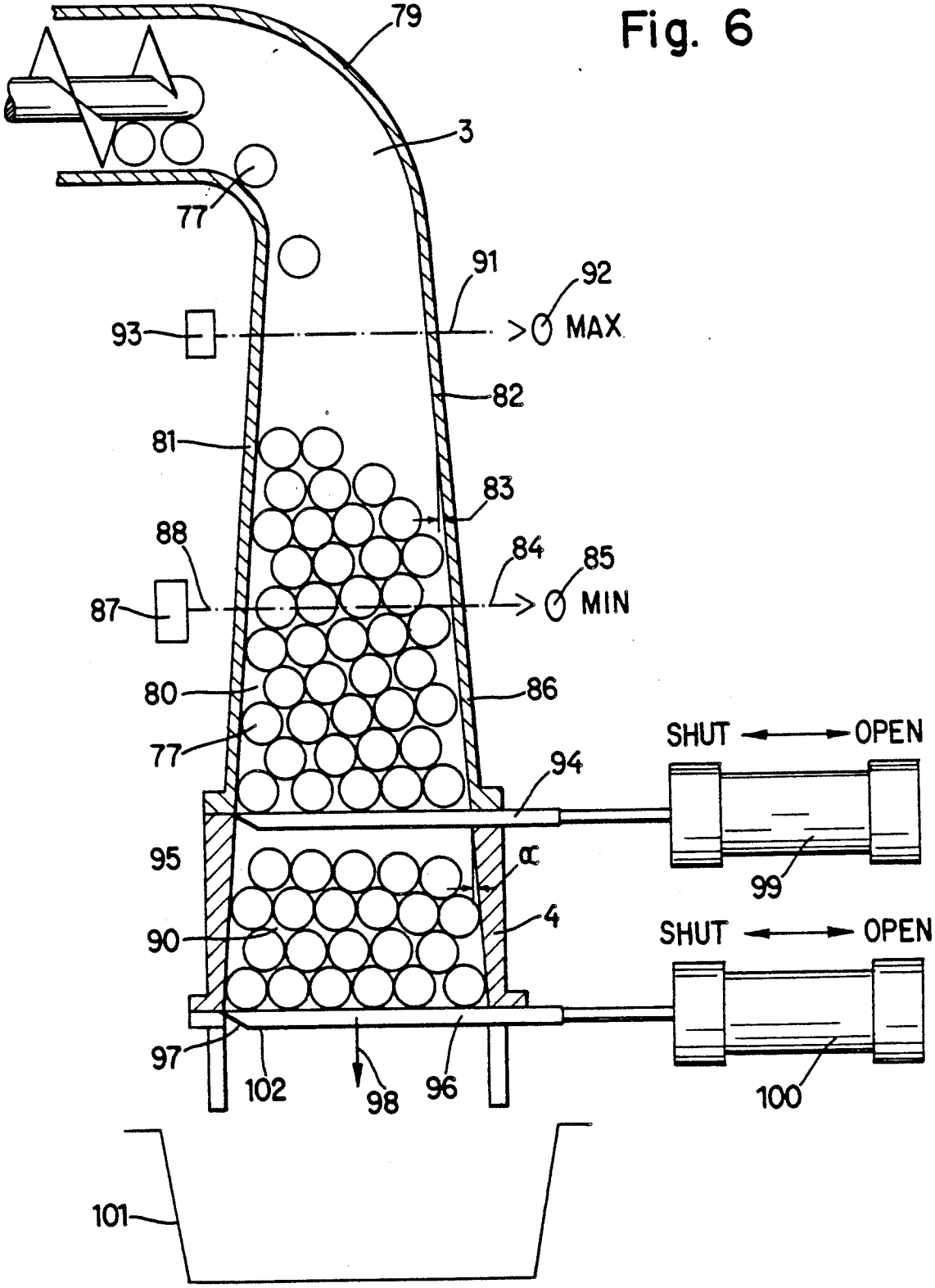
FIG. 6 is a longitudinal section through a conveying shaft.
Figure 7:
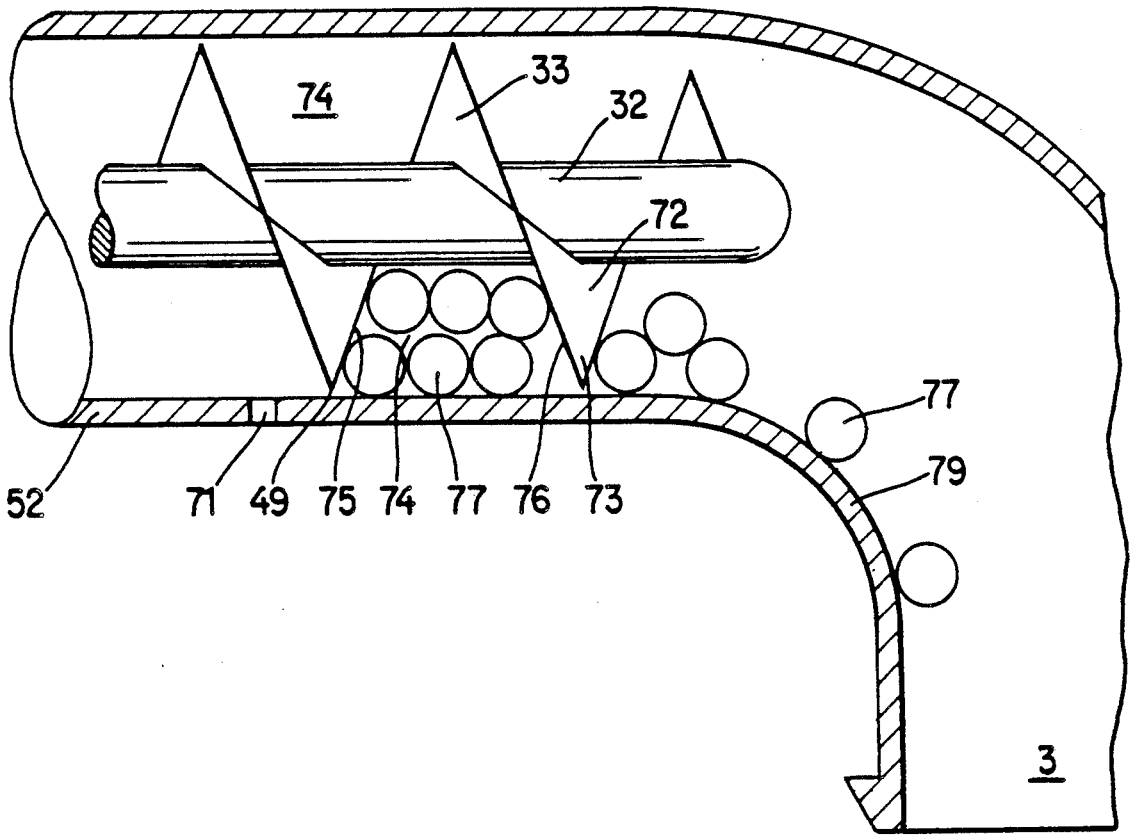
FIG. 7 is an enlarged illustration of a transition from a tube into a conveying shaft.

A first apparatus for carrying out the method according to the invention is shown in part in FIG. 1 and in FIGS. 2 to 7 and consists essentially of a loosening device in the form of a continuously or discontinuously movable mechanical agitator or grab (1), a conveying device (2) which converts loosened components of the product into a stream and equalizes the stream, a conveying shaft or duct (3) which gathers a column of components from successive increments of the stream and a distributing or metering device (4). The grab (1), which engages a product (6) in a supply (5) with grabbing and agitating arms (7) to draw components of the product from the supply, is arranged in close working relationship with the conveying device (2) to which it supplies the product (6) removed from the supply (5). To this end, the grab (1) can be constructed as a shaft (8) which extends through an outlet (10) of a supply vessel (11) transversely to a flow direction (9). The shaft (8) here passes through a cylindrical part (12) of the supply vessel (11) and the cylindrical part (12), as considered in the flow direction (9), is disposed immediately downstream of walls (13) belonging to the supply vessel (11) and inclined in a funnel-like fashion. The ends (14) of the grabbing arms (7) facing away from the shaft (8) extend far into the region of the supply vessel (11) defined by the funnel-like walls (13). On the other hand, the ends (14) lie immediately outside of an operative region of the conveying device (2).

The grabbing arms (7) can be constructed as hooks (15) or screws (16). Also practicable is an arrangement in which both hooks (15) and a screw (16) are secured to the shaft (8). One end (17) of each hook (15) is fixed to the shaft (8). The hook (15) merges tangentially into a surface (18) of the shaft (8) facing the end (14) and extends radially outward towards, and merges into, a circular path concentric with the surface (18). The sheet constituting the hook (15) defines an approximately circular ring in the region of this circular path so that the end (14) constituting part of the grabbing arm (7) and located in the vicinity of the ring-like circular path lies above the end (17) which is connected to the shaft (8). The end (14) is advantageously provided with a straight edge (19) transverse to the direction of the sheet. The sheet has a profile which, at the longitudinal edge (20) thereof facing away from the shaft (8), is beveled in the form of a roof (21). The sheet of the grabbing arm (7) extends in a plane which is perpendicular to a central line extending through the shaft (8).

Depending upon the length of the shaft (8), several of these hooks (15) are arranged at a uniform distance from one another with parallel faces. They are secured to the surface (18) at their ends (17) and, in longitudinal direction of the shaft (8), are offset relative to one another by approximately equal distances so that, in the direction of rotation of the shaft (8), the ends (14) facing away from the shaft (8) are offset relative to one another to the same degree. This has the result that, with reference to an imaginary engagement line through the supply (5), the product (6) is loosened and sent to the conveying device (2) at spaced time intervals, as considered in longitudinal direction of the shaft (8), which are a function of the rotational speed of the shaft (8). The conveying device (2) thus always operates, in an operating mode matched to the rotational speed of the shaft (8), with a charge of approximately the same size and without the possibility of a cavity developing internally of the product (6) between the grab (1) and the conveying device (2).

The hooks (15) are advantageously distributed over only a rearward portion (22) of the grab (1), as considered in the conveying direction of the conveying device (2), while a grabbing arm (7) constructed as a screw (16) is secured to a forward portion (23) of the grab (1) which is adjacent to the rearward portion (22). This screw (16) can be provided in a portion of the grab (1) which is separated from the conveying device (2) by a cover (24. In the region of this cover (24), the conveying device (2) does not take up the product (6) which has been loosened by the grab (1).

The front end (25) of the screw (16) is secured to a front end (26) of the shaft (8) which faces away from the hooks (15). The screw (16) is in the form of a sheet which is coiled around approximately one-third of the total length of the shaft (8) in the region of the cover (24). The screw (16) has an outer diameter (27) which faces away from the shaft (8) and is spaced from the latter by a distance corresponding to that between the ends (14) and the shaft (8). The outer edge (28) of the screw (16) extends along this outer diameter whereas an inner edge (29), which is parallel to the outer edge (28), confronts the surface (18) of the shaft (8) and surrounds it at an approximately uniform distance. The screw (16) has a pitch such that the product (6) loosened from the supply (5) by the screw (16) is transported in a direction towards the hooks (15). The shaft (8) has a direction of rotation which causes the longitudinal edges (20) constituting part of the hooks (15) and facing away from the shaft (8) to engage the product (6) so that this is pushed in the flow direction (9). Consequently, as considered in the direction of rotation of the shaft (8), the hooks (15) and screw (16) make initial contact with the product (6) at the longitudinal edges (20) and outer edge (27), respectively, and the hooks (15) as well as the screw (16) loosen the product (6) from the supply (5) upon such contact in the region of the ends thereof (14 and 30, respectively) which face away from the shaft (8). The inner edge of the screw (16) can be secured to the surface (18) of the shaft (8). However, it is also conceivable that there be no contact for support of the screw (16) between the inner edge (29) and the surface (18) and that, instead, the screw (16) be coiled around the surface (18) of the shaft (8) so as to swing freely.

The conveying device (2) is constructed as a screw conveyor (31) in which a screw (33) is coiled around a shaft (32). This screw (33) has a pitch, as considered in the direction of rotation of the shaft (32) which causes the product (6) to be transported away from the outlet (10) of the supply vessel (11). This pitch increases continuously for all of the spirals (34) constituting the screw (33). The shaft (32) extends approximately parallel to the shaft (8) through the cylindrical part (12) of the supply vessel (11) and is located below the shaft (8) as considered in the flow direction (9) of the product (6). Both shafts (8 and 32) are journalled in a floating fashion in a wall (35) defining the cylindrical part (12). Bearing housings (36,37) are secured to this wall (35) and a stub (38,39) of one of the shafts (8,32) is journalled in a floating fashion in a respective bearing housing (36,37). The stubs (38,39) narrow in a direction towards the shafts (8,32) and are in the form of cones (40,41) which are journalled in corresponding conical bearings (42,43). The cones (40,41) can be extended from these bearings (42,43) in a direction towards the ends (44,45) facing away from the shafts (8,32) so that an annular space is formed between the cones (40,41), on the one hand, and the bearings (42,43), on the other hand. A cleansing fluid can be passed through this annular space which is created in the extended condition of the shafts (8,32) and is admitted into the annular space via cleansing openings (46,47). These cleansing openings (46,47) are provided in the bearing housings (36,37) and communicate, on the one hand, with a cleansing system (48) and, on the other hand, with the interiors of the bearing housings (36,37) in the regions of the conical bearings (42,43).

The screw (33) has an outer diameter (49) which is constant over the entire length of the conveying device (2) and lies immediately below a working line described by the ends (14) of the hooks (15). This outer diameter (49) describes a circular arc (50) as considered in the direction of rotation of the shaft (32). Such circular arc (50) extends, with a small clearance, along an inner wall (51) of a tube (52) which surrounds the screw (33) in the manner of a housing. This tube (52) extends from the cylindrical part (12) of the supply vessel (11), and coaxially with the shaft (32), in a direction towards the conveying shaft (3). It is fixed in a wall (53) which is located opposite the wall (35) and, together with the latter, defines the outlet (10) of the supply vessel (11). The tube (52) has an end (54) in the region of the cylindrical part (12) and the cover (24) extends to the end (54). Between this end (54) and the wall (35) disposed opposite the same, the tube (52) is provided with a cutout (55) in the region of which the tube (52) consists only of a lower shell (56) facing away from the grab (1). This lower shell (56) is connected with the supply vessel (11) by means of funnel-like walls (57,58,59,60) which extend in the longitudinal direction of the shafts (8,32). The upper regions of these walls (57,58,59,60), which face away from the lower shell (56), define a housing (61) and the grabbing arms (7) move along the walls of such housing (61).

The cutout (55) extends, as considered in longitudinal direction of the shafts (8,32), along a section of the screw (33) in which the product (6) is supplied to the screw (33) by the grabbing arms (7). Adequate filling of the grab (1) in the region of the cutout (55) is assured by the screw (16) which advances the product (6) from the region of the cover (24) in a direction towards the cutout (55).

A calibration (63) is provided in the inner wall (51) of the tube (52) and extends along the entire length of the latter. This calibration (63) guides a product stream moving in a direction towards the conveying shaft (3). To this end, it consists of facets (64) which extend in longitudinal direction of the tube (52) and are uniformly distributed on the inner wall (51). The number of facets (64) depends upon the cross section of the tube (52). A land (65) is defined between each pair of neighboring facets (64). Each of the facets (64) extends in the form of a sawtooth in a wall defining the tube (52). This sawtooth has a tip (66) which penetrates most deeply into the wall. This tip (66) is connected with two neighboring pressing tips (69,70) by a long flank (67) and a short flank (68), respectively. Pressing edges extend longitudinally of the tube (52) over the length thereof in the regions of these pressing tips (69,70) and define an abutment against which the product (6) bears as it is advanced inside the tube (52). Hence, the pressing edges extending in the regions of the pressing tips (69,70) prevent the product (6) from becoming obstructed internally of the tube (52) so that it is no longer advanced by the screw (33).

The same purpose is served by ventilating bores (71) which are provided in the tube (52) and permit the escape of air which can collect between the individual components of the product (6) during advance of the latter. Such ventilation of the tube (52) achieves a uniform feed of the product by the screw (33) in a direction towards the conveying shaft (3).

Furthermore, the screw (33) has a blade profile (72) which narrows in the form of a cone (73) from the shaft (32) in a direction towards the wall (65) of the tube (52). This ensures that a transporting space (74) formed between two neighboring blade profiles (72) is bounded by walls (75,76) which are inclined in opposite directions. Consequently, the cross section of the transporting space (74) in the region of the shaft (32) is smaller than in the region of the outer diameter (49) of the screw (33). This design of the transporting space (74) enhances a discharge of the product (6) consisting of the individual components (77) in a direction towards the conveying shaft (3).

At the end (78) thereof facing away from the supply vessel (11), the tube (52) extends at a right angle, in the form of a bend (79), out of its horizontal orientation and in a direction towards the vertically extending conveying shaft (3). It is also possible here for the bend (79) to be secured to the conveying shaft (3). The conveying shaft (3) widens in the form of a cone (80) immediately following the bend (79). To this end, at least two oppositely disposed walls (81,82) are arranged such that they are closest to one another in the region of the bend (79) and continuously separate from one another in a direction towards the distributing device (4). The conveying shaft (3) has its largest cross section in the region of the distributing device (4). The rate at which the cross section increases in a direction towards the distributing device (4) is a function of an angle of inclination (83) the magnitude of which is selected in dependence upon the consistency of the product (6). The angle of inclination (83) increases with increasing tendency of the individual components (77) of the product (6) to form an obstruction in the conveying shaft (3).

A measuring section (84) is arranged inside the conveying shaft (3). This measuring section (84) consists essentially of a sensor (85) which is directed towards a wall (86) surrounding the conveying shaft (3). A receiver (87) on the side of the conveying shaft (3) opposite the sensor (85) is associated with the latter. A portion (88) of measuring section (84), through which the product (6) travels in a direction towards the distributing device (4), extends between the sensor (85) and the receiver (87). The sensor (85) can, for example, emit light rays which are received by photocells constituting the receiver (87). The light rays penetrate the walls (81,82) which constitute part of the conveying shaft (3) and are composed of a transparent material such as, for example, plexiglas.

As soon as the receiver (87) receives a signal due to insufficient filling of the conveying shaft (3), it switches on the conveying device (2) so that this advances the product (6) into the conveying shaft (3). As soon as the product (6) within the conveying shaft (3) reaches a height such that it prevents passage of the light rays in a direction towards the receiver (87), a switching pulse which shuts off the conveying device (2) is generated. The measuring section (84) is advantageously disposed at a location of the conveying shaft (3) which is at such a height above the distributing device (4) that the capacity of this portion of the conveying shaft (3) is sufficient to fill a measuring chamber (90) of the distributing device (4). As soon as the product (6) has left the conveying shaft (3) and entered the measuring chamber (90), the receiver (87) switches on the conveying device (2) so that fresh product (6) is filled into the conveying shaft (3). All pulse generators, and primarily those operating without contact, may be used for the sensor (85).

In order to ensure progressive emptying of the conveying shaft (3) in a direction towards the measuring chamber (90), a quantity of the product (5) sufficient to again quickly fill the measuring chamber (90) after each discharge thereof is accumulated in the conveying shaft (3). For this reason, the conveying device (2) is, to the extent possible, regulated in such a manner that it is continuously in operation so that the product (6) advanced by the conveying device (2) is continuously in motion to thereby prevent the development of an obstruction. To this end, aside from the measuring section (84), a maximum measuring section (91) equipped with a sensor (92) and an associated receiver (93) is provided in the region of the conveying shaft (3). This maximum measuring section (91) is disposed within the conveying shaft (3) above the measuring section (84) as considered in a direction towards the convey device (2). The receiver (93) of the maximum measuring section (91) generates a switching pulse as soon as the product (6) prevents passage of the rays from the sensor (92) in a direction towards the receiver (93). This switching pulse shuts off the conveying device (2).

When the conveying device (2) is shut off, the product (6) is removed from the conveying shaft (3) in a direction towards the distributing device (4). As soon as a quantity of sufficient to empty the measuring section (91) has been removed from the conveying shaft (3), a switching pulse emitted by the receiver (87) switches on the conveying device (2) again so that the conveying shaft (3) is once more filled to the maximum measuring section (91).

Under normal conditions, the distributing device (4) can maintain its conveying speed in order to replace the respective quantities of the product (6) measured out by the measuring chamber (90). The measuring sections (84,91) are intended to regulate the distributing device (4) only under irregular operating conditions.

The distributing device (4) consists essentially of two slide valves having approximately parallel planes and including an inlet slide valve (94) which regulates an inlet (95), and an outlet slide valve (96) which regulates an outlet (97), of the measuring chamber (90). The two slide valves (94,96) extend transverse to the direction (98) in which the product (6) is conveyed through the conveying shaft (3). A drive (99) is associated with the inlet slide valve (94) while a drive (100) is associated with the outlet slide valve (96). The inlet slide valve (94) faces the conveying shaft (3) whereas the outlet slide valve (96) faces a packing unit (101) which is to be filled and, during filling, is disposed below an outlet opening (102) constituting part of the measuring chamber (90) and closable by the outlet slide valve (96). The packing unit (101) can be transported along a path beneath the column of components in the shaft or duct (3) in a direction towards the outlet opening (102), and again transported away after filling, by a conveyor (103) extending below the measuring chamber (90). A plurality of packing units (101',101'') be disposed one behind the other on the conveyor (103).

After the conveyor (103) has transported the packing unit (101) underneath the outlet opening (102), the drive (100) of the outlet slide valve (96) is activated. It opens the outlet opening (102) so that the product (6) falls out of the measuring chamber (90) into the packing unit (101) by gravity. Emptying of the measuring chamber (90) is enhanced because it widens conically from the inlet (95) in a direction towards the outlet (97).

Once the measuring chamber (90) has been emptied, the outlet slide valve (96) closes the outlet opening (102). Immediately thereafter, the drive (99) opens the inlet (95) so that the product (6) can flow out of the conveying shaft (3) into the measuring chamber (90). After this is filled, the inlet (95) is once again closed by the inlet slide valve (94). The measuring chamber (90) can now again be emptied via the outlet opening (102).

Due to removal of the product (6) from the conveying shaft (3) in a direction towards the measuring chamber (90), the receiver (93) for the rays issuing from the sensor (92) is exposed. The impinging rays cause the receiver (93) to generate a switching pulse which sets the conveying device (2) in motion. This conveys fresh product (6) out of the supply (5) in a direction towards the conveying shaft (3). As soon as this is filled to the maximum measuring section (91), the rays emitted by the sensor (92) in a direction towards the receiver (93) are prevented from passing so that the latter generates a further signal which is adapted to stop the conveying device (2).

It is, however, also possible to first place the conveying device (2) in operation when the receiver (87) generates a switching pulse due to the rays emitted by the sensor (85). At this moment, the quantity of product (6) heaped in the conveying shaft (3) falls below a minimum value so that it is necessary to fill the conveying shaft (3) with a further charge of product (6) by means of the conveying device (2). The conveying speed of the conveying device (2) can here be selected in such a manner that the product stream entering the conveying shaft (3) fills the conveying shaft (3) to a location immediately below the maximum measuring section (91) before product (6) is once again removed from the conveying shaft (3) in a direction towards the measuring chamber (90). In this manner, continuous operation is achieved for the conveying device (2) which every time fills the conveying shaft (3) to the maximum measuring section (91) while the product (6) is emptied into the packing unit (101) via the measuring chamber (90).

A measuring or metering chamber or vessel (104) can, however, also be mounted on a rotary slide valve (105) which is pivotally installed in a housing (106), see FIGS. 1 and 10 to 16. The housing (106) and the rotary slide valve (105) have a common longitudinal axis (107) which is essentially horizontal. The interior (108) of the housing (106) has a circular cross section. The shape of the interior (108) is matched to the rotary slide valve (105) whose outer walls (109) likewise have a circular cross section.

An inlet opening (111) and an opposed outlet opening (112) are respectively provided at two diametrically opposite locations of the walls (110) of the housing (106). The conveyor (103) extends below the outlet opening (112) and a packing unit (101) stands on the conveyor (103) in the region of the outlet opening (112).

In contrast to the embodiment of FIGS. 2 to 7, the inlet opening (111) is

In contrast connected with the conveying shaft (3) in which the sensors (85 and 92) are installed above the inlet opening (111).

The measuring vessel (104) is designed as a recess which is formed in the rotary slide valve (105) and is located directly below the inlet opening (111). The measuring vessel (104) has a bottom (113) disposed opposite the inlet opening (111) and connected, via side walls (114,115), with an approximately circular inlet section (116) through which the product (6) is filled into the measuring vessel (104). The side walls (114) correspondingly extend through the rotary slide valve (105) in the form of a half shell and merge into the bottom (113) in the form of a relative large radius (117). The bottom (113) extends approximately along the central line (107).

The side wall (115) located opposite the side wall (114) is movable longitudinally of the rotary slide valve (105). It constitutes a front end of a piston (118) which is slidably mounted in a guide (119) extending longitudinally through the rotary slide valve (105). This guide (119) has a semicircular cross section (120) and a piston rod (121) connected with the piston (118) is mounted on the walls of the cross section (120). The piston rod can have an approximately square cross section (122) the edges (123,124) of which are rounded and slide on the guide (119). It is, however, also possible to match the cross section-,of the piston rod (121) to that of the guide (119). The end (125) of the piston rod (121) facing away from the piston (118) projects out of the housing (106). The end (125) of the piston rod (121) is provided with a coupling (126) which can be in the form of a blind bore. The piston rod (121) is connected, via this coupling (126), with a drive which can shift the piston (118) longitudinally of the housing (106). By shifting the piston (118), the side wall (115) can be pushed in a direction towards the oppositely disposed side wall (114) to thereby reduce or, by an opposite motion, increase of the volume or capacity of the measuring vessel (104).

To this end, the piston (118) has the form of a circular arc, which matches the circular cross section of the measuring vessel (104), in the region of the side wall (115). In transverse direction of the rotary slide valve (105), the piston (118) extends along the walls of the interior (108) via a semicircular segment. In the region of the central line (107), the movable side wall (115)

merges into the measuring vessel (104) with a radius (128) corresponding to the radius (117).

The piston (118) can be connected with the piston rod (121) in any manner, for example, by means of weld seams (129,130). The weld seams (129,130) have a curved surface which is easily accessible for cleaning.

The end (131) of the rotary slide valve (105) facing away from the measuring vessel (104) projects out of the housing (106). The rotary slide valve (105) is provided with a coupling (132) in the region of the end (131) and a non-illustrated rotary drive is connected to this coupling (132), for example, via a pinion (133). By means of this pinion (133), the rotary slide valve (105) can be pivoted inside the housing (106) about the axis (107). The end (125) of the piston rod (121), which is guided in the region of the pinion (133), projects out of the end (131) of the rotary slide valve (105).

At the end (134) thereof facing away from the end (131), the rotary slide valve (105) is bounded by a circular wall which is situated opposite a corresponding end wall (135) of the housing (106). When the rotary slide valve (105) is in operative position inside the housing (106) with its measuring vessel (104) below the inlet opening (111), a free space (136) is present between the end (134) of the rotary slide valve (105) and the end wall (135). An inlet nozzle (137) connected with a non-illustrated pressurized gas system projects into this free space (136). A preferred pressurized gas is nitrogen which is adapted to have a preservative effect on the product (6) packed in the packing units (101).

A channel (138) extends from the free space (136) through the rotary slide valve (105) and initially runs parallel to the central axis (107) in a lower portion of the rotary slide valve (105) facing away from the measuring vessel (104). This channel (138) turns at a right angle within the rotary slide valve (105) in a direction towards the bottom (113) into which it opens with a distributing funnel (139). The pressurized gas which fills the free space (136) via the inlet nozzle (137) can be admitted into the measuring vessel (104) through this channel (138) as soon as the measuring vessel (104) is directed towards the outlet opening (112) in the pivoted condition of the rotary slide valve (105). In order to enhance rinsing out of the product by means of the pressurized gas, baffles for directing the pressurized gas along the walls of the measuring vessel (104) can be arranged in the distributing funnel (139) so that the pressurized gas loosens the product from the walls and conveys it towards the outlet opening (112). In this manner, the product (6) is emptied completely in a direction towards the packing unit (101). Furthermore, the cross section of the measuring vessel (104) narrows in a funnel-like fashion from the inlet section (116) in a direction towards the bottom (113) so that emptying of the measuring vessel (104) in a direction towards the packing unit (101) is enhanced also by this configuration of the measuring vessel (104).

Prior to initiating the filling operation, the volume of the measuring vessel (104) is matched to the capacity of a packing unit (101). This matching takes place by pushing the piston (118) in a direction towards the side wall (114) in accordance with the particular volume required. If the product (6) is to be filled into very small packing units (101), it is possible to insert in the housing (106) a rotary slide valve (105) in which the measuring vessel (104) does not extend to the axis (107) but where, in the nonpivoted condition of the rotary slide valve (105), the bottom (113) extends in a plane lying between the axis (107) and the inlet section (116). The piston (118) is also to be designed in accordance with the rotary slide valve being used.

Conveying of the product (6) through the conveying shaft (3) in a direction towards the inlet opening (111) then begins. As soon as the measuring vessel (104) is filled, the rotary slide valve (115) is tilted 180° to change the orientation of a metered quantity of components in the vessel (104) so that the inlet section (116) is adjacent to the outlet opening (112). The product (6) accumulated in the measuring vessel (104) is then evacuated through the outlet opening (112) in a direction towards the packing unit (101) standing beneath the outlet opening (112).

Should residues of the product (6) fail to loosen from the measuring vessel (104), a pressurized gas can be introduced into the measuring vessel (104) through the channel (138). This pressurized gas pushes the residues of the product (6) out of the measuring vessel (104) into the packing unit (101).

Meanwhile, the conveying device (2) has advanced additional product (5) into the conveying shaft (3). This is piled above the tilted rotary slide valve (105) up to the measuring section (84). As soon as the rotary slide valve (105) has again returned to its nonpivoted position, the product (6) accumulated in the conveying shaft (3) falls into the measuring vessel (104) until this is filled. After filling of the measuring vessel (104), the rotary slide valve (105), together with the piston (118), is again tilted in a direction towards the outlet opening (112) so that the product (6) can once more accumulate in the conveying shaft (3). If, in exceptional situations, the product (6) piles up in the conveying shaft (3) to the level of the maximum measuring section (91), the conveying device (2) is stopped by a measuring pulse emitted by the receiver (93).

Figure 9:
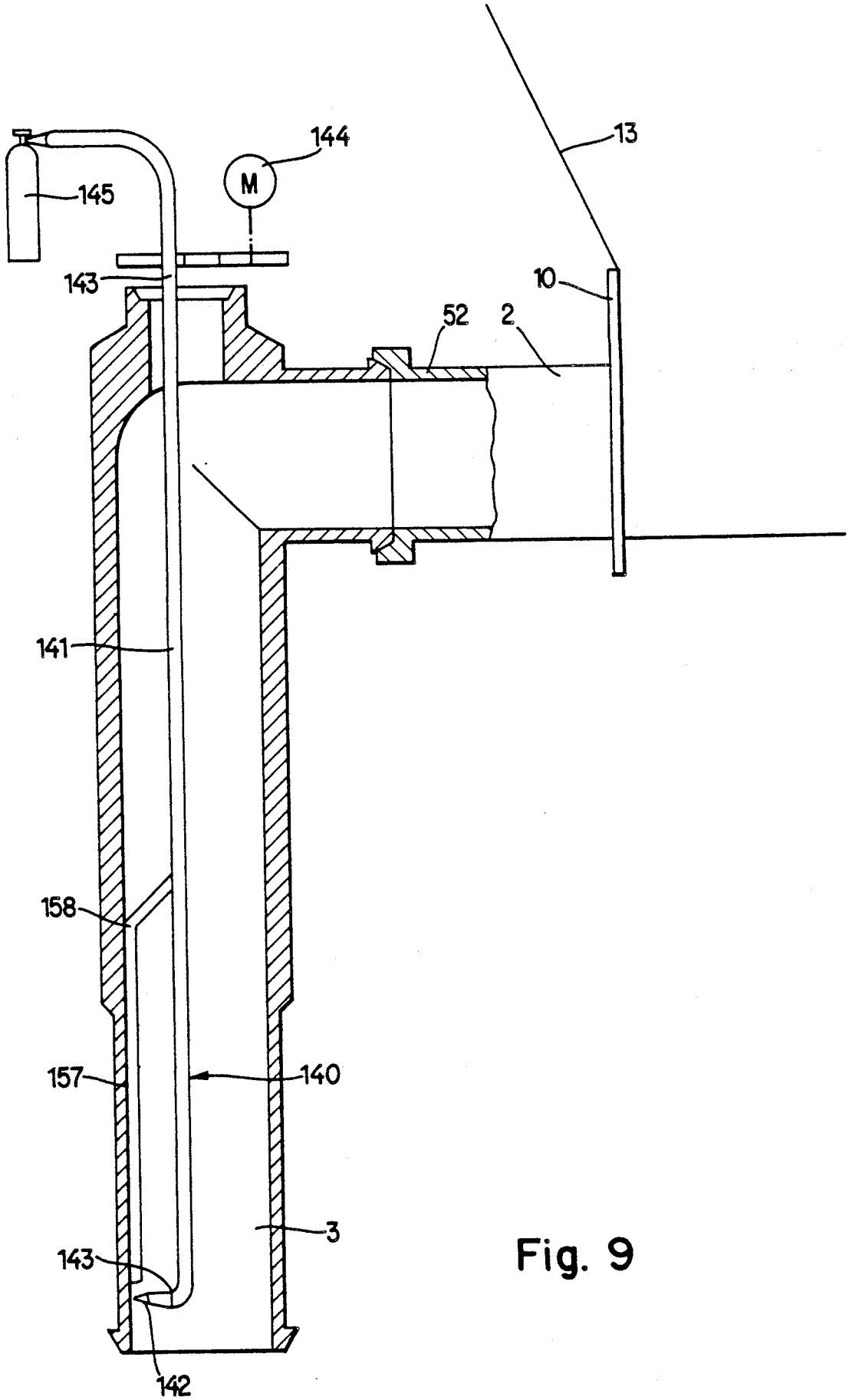
FIG. 9 is a longitudinal section through a conveying shaft having a loosening device.

A loosening device (140) which is shown in FIG. 9 can be provided in the conveying shaft (3) as an additional safety measure. This takes the form of a rod-like article, for example, a tube, which extends through the conveying shaft (3) longitudinally of the latter, for example, parallel to its central axis (141). The lower end (142) of the loosening device (140) projects into the conveying shaft (3) to a location immediately above the inlet opening (111). At this location, the lower end (142) is bent at a right angle into the form of a hook (143) and extends transverse to the conveying shaft (3). The loosening device (140) has a connecting section (143) which projects out of the conveying shaft (3) at the end thereof facing away from the inlet opening (111). This connecting section (143) is pivotally coupled to a rotary drive (144) so that the loosening device (140) can be rotated about its central axis inside the conveying shaft (3). During rotation, the hook (142) performs rotary motions which are capable of loosening a product obstruction in the lower end of the conveying shaft (3). Moreover, the loosening device (140), which is constructed as a tube, can be connected with a vessel (145) for pressurized gas. The pressurized gas, for example, nitrogen, contained in the pressurized gas vessel (145) is admitted into the conveying shaft (3) during movement of the loosening device (140) so that this pressurized gas can likewise break up obstructions inside the conveying shaft (3). In addition, by displacing oxygen, pressurized gas constituted by nitrogen has a conserving action inside the packing unit (101).

A scraper (157) which is shown in FIG. 9 can be connected with the loosening device (140) so as to be guided along the inner wall of the conveying shaft (3) when the loosening device (140) is rotated about its central axis. The scraper (157) branches away from the loosening device (140) in a direction towards the inner wall by means of a projection (158).

Figure 8:
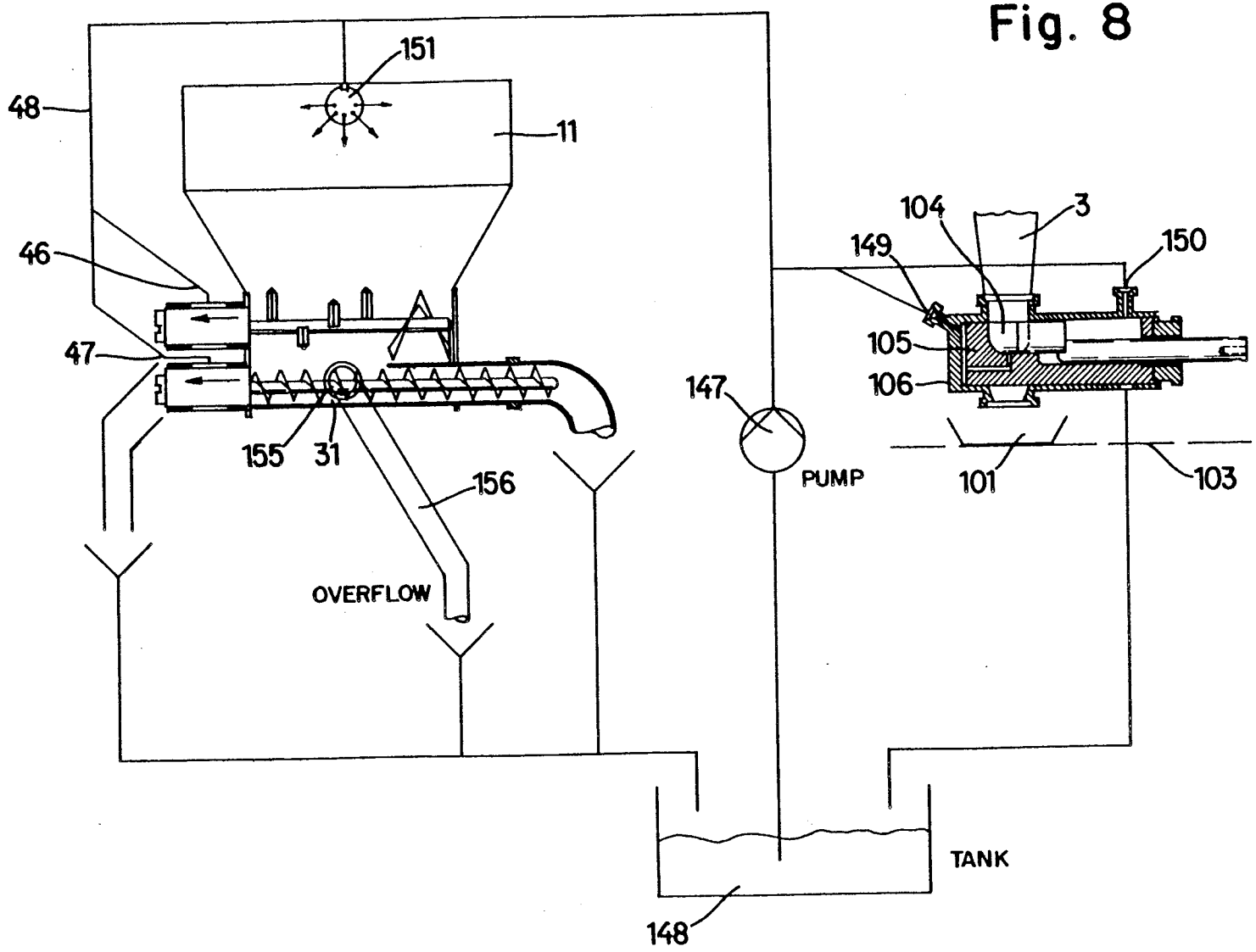
FIG. 8 is a schematic of a cleansing system in the region of the grabbing tools of the conveying device and the conveying shaft.
Figure 10:
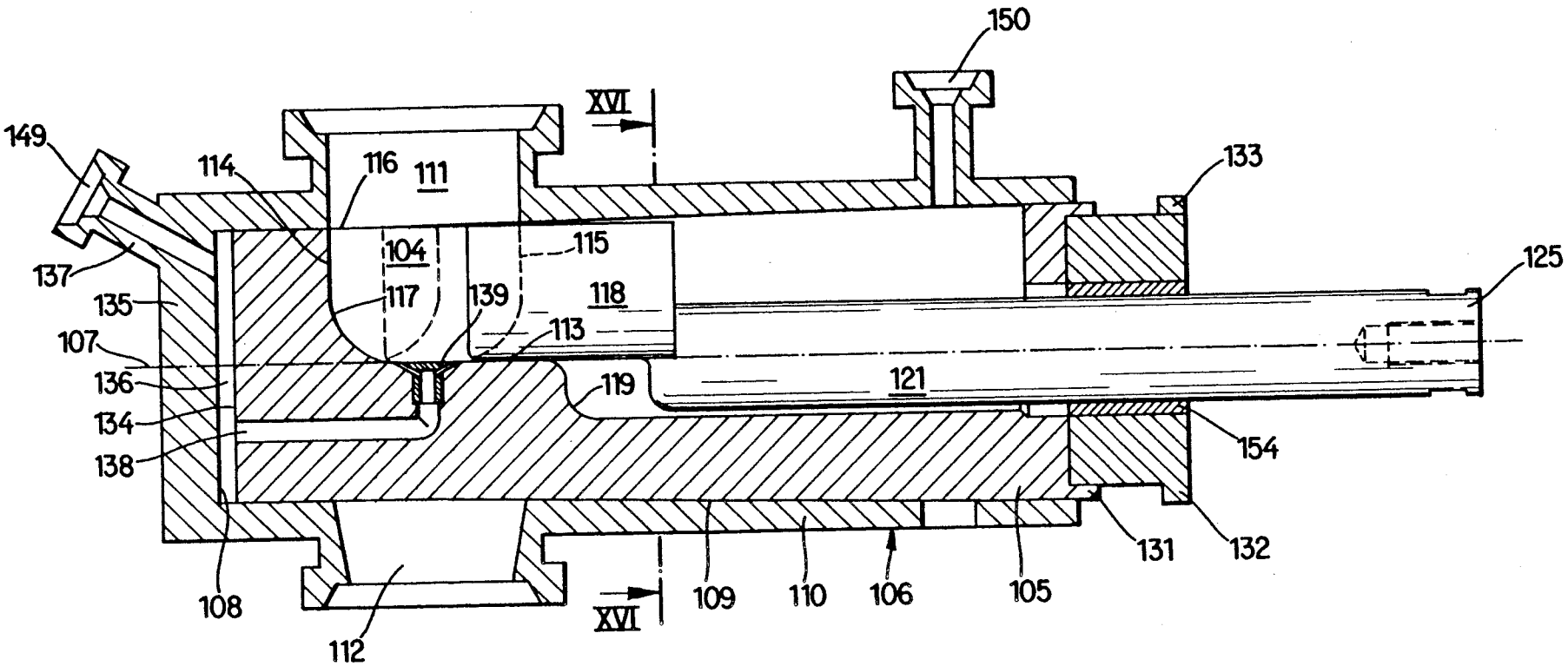
FIG. 10 is a longitudinal section through a distributing device.
Figure 11:
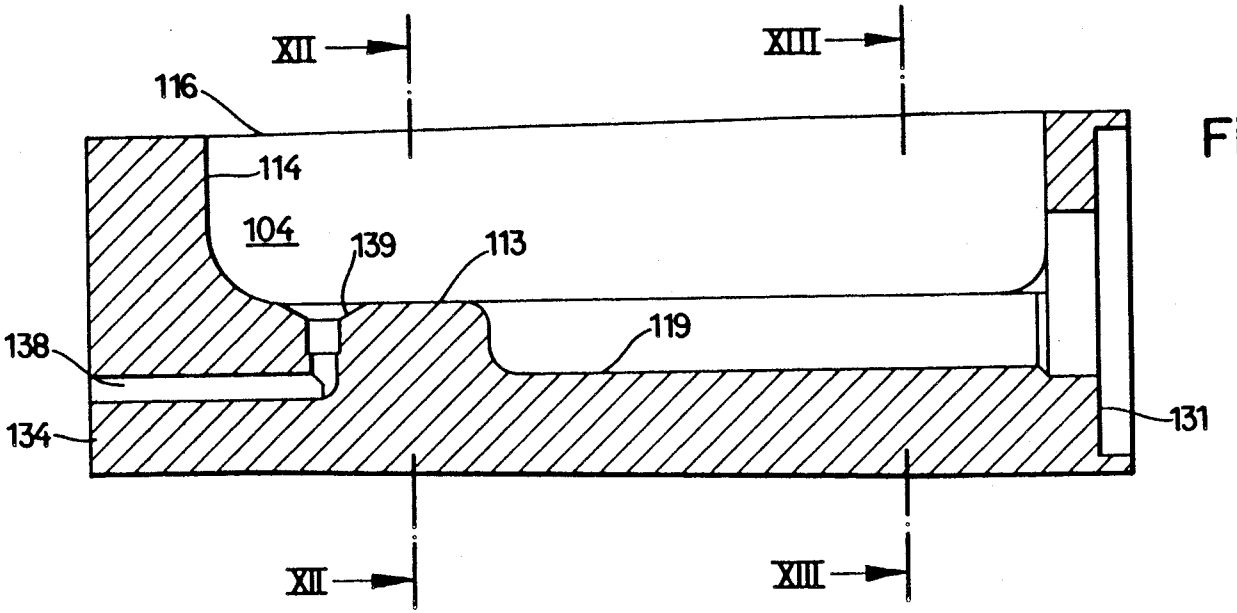
FIG. 11 is a longitudinal section through a rotary slide valve.
Figure 13:
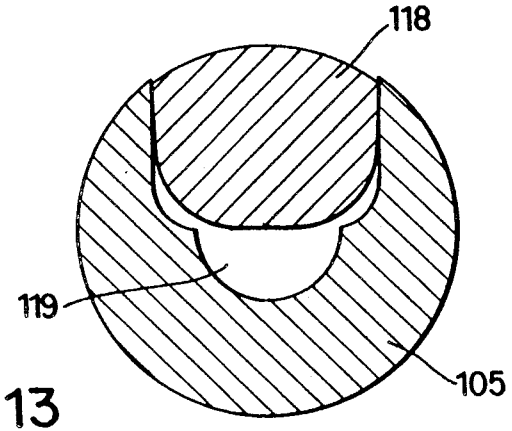
FIG. 13 is a cross section of a rotary slide valve along the section line XIII—XII of FIG. 11.
Figure 12:
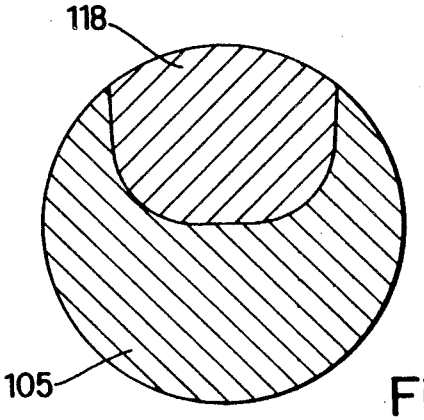
FIG. 12 is a cross section of the upper portion of a rotary slide valve along the section line XII—XII of FIG. 11.

All parts of the apparatus can be connected to one another within the cleansing system of (48) of FIG. 8. This cleansing system consists of pipes which open into a tank (148) for a cleansing agent via a pump (147). The cleansing agent collects in this cleansing agent tank (148). The pipes of the cleansing system (48) open not only into the cleansing openings (46,47) of the bearing housings (36,37) but also into suitable nozzles (149,150) which are also shown in FIG. 10 and communicate with (108) of the housing (106). In this manner, the rotary slide valve (105) can be incorporated into the cleansing system (48). To this end, the rotary slide valve (105) is conical and narrows conically from its end (131) in a direction towards the end (134). Correspondingly, the interior (108) has walls which narrow conically in a direction towards the end wall (135) and support the outer wall (109) of the rotary slide valve (105). In its operating position, the outer wall (109) is guided on all sides on the wall (110). For cleansing purposes, the rotary slide valve (105) is drawn out of the housing (106) so far in a direction towards the end (131) of the rotary slide valve (105) that a gap develops between the wall (110) and the outer wall (109). The cleansing liquid which enters the interior (108) via the nozzles (149,150) is passed through this gap. The cleansing liquid again enters the cleansing system (48) by means of a non-illustrated outlet nozzle and collects in the cleansing agent tank (148). Moreover, discharge openings (151) are also provided in the region of the supply vessel (11) so that this, also, can be rinsed by the cleansing liquid.

Figure 14:
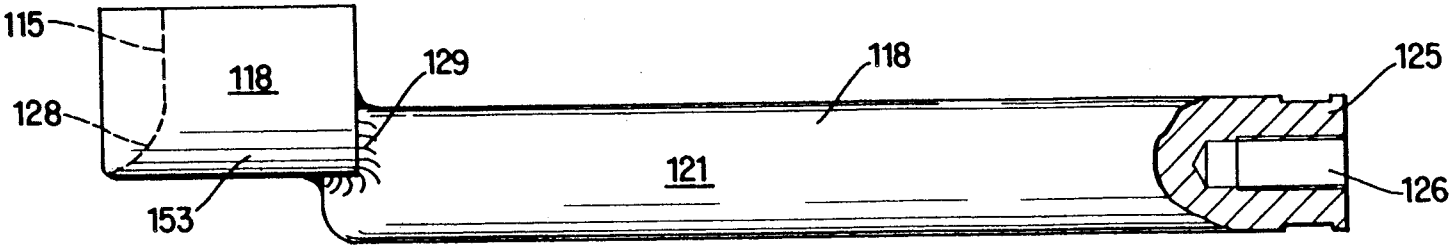
FIG. 14 is a side view of a rod with a wall of a measuring vessel welded thereto.
Figure 16:
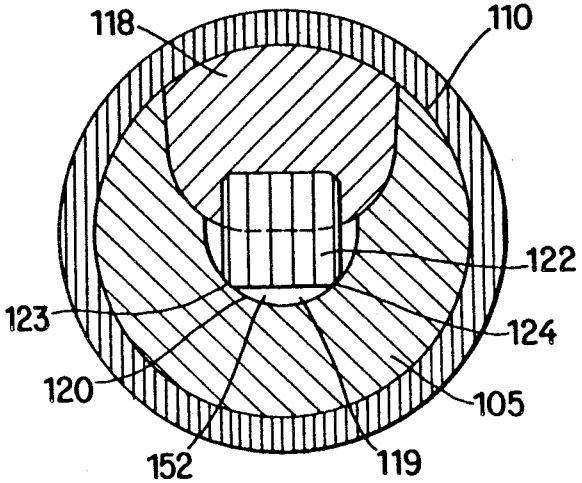
FIG. 15 is a plan view of a front portion of a rod having a wall welded thereto and FIG. 16 is a cross section of a distributing device along the section line XVI—XVI of FIG. 10.
Figure 15:
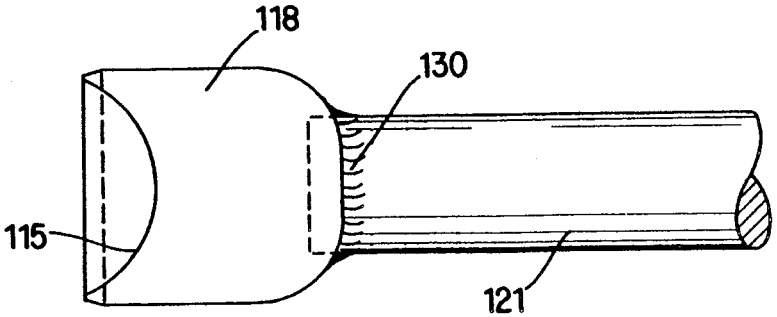

In order to be able to ensure good rinsing of the piston (118) in a cleansing position assumed by the same and, at the same time, to have a tight seal between the piston (118) and its guideway (152) which is shown in FIG. 16, such guideway (152) has a varying profile along the direction of movement of the, piston (118). The piston (118) has a boundary surface which is shown in FIG. 14 and is matched to the guideway (152) and guided in the latter throughout the entire region in which the front side of the piston (118) facing the measuring vessel (104) forms the side wall (115) of the measuring vessel (104). On the other hand, outside of this region in a direction towards the end (131) of the rotary slide valve (105), the guideway (152) has a profile in which the radii are smaller than those of the boundary surface (153). Accordingly, the piston (118) raises itself from the guideway (152) when it is shifted in this region. The radii of the piston (118), which are larger than the radii of the guideway (152), are supported on the side walls of the guideway (152) so that the piston (118) can be rinsed by the cleansing liquid on all sides. Precise guidance of the piston rod (121) is achieved by means of a sliding bushing (154) which is shown in FIG. 10 and which, in the region of the coupling (132), receives the part of the piston rod (121) projecting from the end (131) of the rotary slide valve (105) in a sliding fashion.

To prevent the cleansing agent from accumulating in the housing (61) to such an extent during the rinsing procedure that the screw conveyor (31), and possibly also the grab (1), are completely immersed in the cleansing fluid, the housing (61) is provided with overflow bores (155) shown in FIG. 8. The cleansing liquid enters the cleansing system, for example, the cleansing agent tank (148), through these overflow bores (155) and a pipe (156) shown in FIG. 8. The overflow bores (155) are provided in the housing (61) at a height where the level of the cleansing agent in the housing (61) must be maintained in order to keep both the grab (1) and the screw conveyor (31) uncovered by the cleansing agent. The grab (1) as well as the screw conveyor (31) are then not shielded by the cleansing agent against impingement by the cleansing agent streams issuing from the outlet openings (151).

We claim:

1. A method of gently packing a product the consistency of which can be affected by external influences and which is composed of a plurality of separable components tending to adhere to one another to at least some extent and being readily deformable under the influence of mechanical forces, comprising the steps of establishing and maintaining a supply of separable components; drawing components from the supply; loosening the withdrawn components; converting the loosened components into a stream and equalizing the stream; conveying the components in successive increments of the equalized stream into a duct wherein the components form a column which tends to descend by gravity; evacuating metered quantities of components from the duct by gravity including admitting metered quantities of components into a measuring vessel having a capacity at least approximating that of the duct; and transferring the metered quantities into discrete packing units.

2. The method of claim 1, wherein said transferring step comprises changing the orientation of evacuated metered quantities between the duct and the respective packing units.

3. The method of claim 1, wherein said evacuating step comprises admitting metered quantities of components into a measuring vessel, and further comprising the step of varying the capacity of the vessel.

4. The method of claim 1, wherein said conveying step includes introducing successive increments of the stream into the duct by gravity flow.

5. The method of claim 1, wherein said loosening step comprises agitating the components at the supply.

6. The method of claim 5, wherein said agitating step includes discontinuously moving at least one mechanical agitator with reference to the supply.

7. The method of claim 1, wherein the loosening step includes moving the components in a plurality of different directions.

8. The method of claim 1, wherein said loosening step comprises dividing the drawn components into a plurality of streamlets and said converting step comprises gathering the streamlets into said stream.

9. The method of claim 1, wherein said loosening step includes agitating the components by a plurality of rotary coaxial arms.

10. The method of claim 9, wherein said equalizing step includes moving the stream in the direction of axis about which the arms rotate.

11. The method of claim 1, further comprising the step of conforming the density of the product consisting of loosened components to the speed of the stream.

12. The method of claim 1, wherein said evacuating step includes intermittently discharging metered quantities of components from the duct.

13. The method of claim 1, wherein the quantity of components in the duct matches or approximates the metered quantities.

14. The method of claim 1, further comprising the step of regulating the quantity of components in the duct including varying the speed of the stream.

15. The method of claim 1, further comprising the step of regulating the quantity of components in the stream including varying said drawing step.

16. The method of claim 1, further including the steps of monitoring the quantity of components in the duct and regulating said loosening step as a function of the monitored quantity.

17. The method of claim 1, further comprising the steps of regulating said equalizing step as a function of said evacuating step.

18. The method of claim 1, wherein said equalizing step includes maintaining the stream in motion.

19. The method of claim 1, wherein said loosening step includes vibrating the components.

20. The method of claim 1, further comprising the step of transporting the packing units along a predetermined path beneath the duct, said evacuating step further including establishing a metering chamber between the duct and the path, opening the duct to the chamber and simultaneously sealing the chamber from the path to enable components to descend into and to gather in the chamber by gravity flow, said transferring step comprising sealing the chamber from the duct and opening the chamber to a packing unit in the path to permit evacuation of components from the chamber by gravity flow.

* * * * *